US008141988B2

(12) United States Patent
Hirosawa

(10) Patent No.: US 8,141,988 B2
(45) Date of Patent: Mar. 27, 2012

(54) LIQUID EJECTION HEAD, RECORDING APPARATUS HAVING THE SAME, AND RECORDING METHOD

(75) Inventor: Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 12/484,117

(22) Filed: Jun. 12, 2009

(65) Prior Publication Data

US 2009/0309939 A1 Dec. 17, 2009

(30) Foreign Application Priority Data

Jun. 17, 2008 (JP) ..... 2008-157984
Apr. 30, 2009 (JP) ..... 2009-111125

(51) Int. Cl.
*B41J 2/05* (2006.01)

(52) U.S. Cl. ..... 347/66

(58) Field of Classification Search ..... 347/65, 347/66, 67, 86, 87
See application file for complete search history.

(56) References Cited

U.S. PATENT DOCUMENTS 4,771,295 A * 9/1988 Baker et al. ..... 347/87
5,160,945 A * 11/1992 Drake ..... 347/42
6,158,837 A * 12/2000 Hilton et al. ..... 347/19
6,634,739 B2 * 10/2003 Hayashi et al. ..... 347/86
7,258,418 B2 * 8/2007 Silverbrook ..... 347/29
2007/0222836 A1 9/2007 Kim et al.
2008/0049073 A1 * 2/2008 Lee et al. ..... 347/65

FOREIGN PATENT DOCUMENTS

CN 101041296 A 9/2007
JP 2007-160834 A 6/2007
JP 2007-290245 A 11/2007

OTHER PUBLICATIONS

Chinese Office Action dated Dec. 13, 2010 for Application 200910147261.5.

* cited by examiner

*Primary Examiner* — Anh T. N. Vo
(74) *Attorney, Agent, or Firm* — Canon U.S.A., Inc., IP Division

(57) ABSTRACT

A liquid ejection head includes at least one liquid ejecting substrate for ejecting liquid, a supporting member for supporting the at least one liquid ejecting substrate, the at least one liquid ejecting substrate being fixed to a main surface of the supporting member, and a plurality of liquid supplying members for supplying liquid to the at least one liquid ejecting substrate through the supporting member. A linear expansivity of each of the liquid supplying members is different from a linear expansivity of the supporting member. The plurality of the liquid supplying members are arranged along a longitudinal direction of the supporting member, with each of the liquid supplying members being bonded to a surface that is opposite the main surface of the supporting member.

18 Claims, 14 Drawing Sheets

LIQUID EJECTION HEAD, RECORDING APPARATUS HAVING THE SAME, AND RECORDING METHOD

BACKGROUND OF THE INVENTION

1. Field of the Invention

The present invention relates to a liquid ejection head that ejects liquid such as ink, a recording apparatus having the same and a recording method, such as an ink jet recording head that performs recording with ejected ink droplets.

2. Description of the Related Art

In a liquid ejection head, for example, an ink jet recording head (hereinafter referred to as recording head) used in an ink jet recording apparatus, a recording element substrate provided with a plurality of heaters, such as heating resistance elements, is used as a liquid ejecting substrate for ejecting liquid (e.g., ink). The speed of recording increases with an increase in the number of recording elements provided in a recording element substrate, or with an increase in the recording width.

Japanese Patent Laid-Open No. 2007-160834 discloses a so-called full-line type recording head in which a plurality of recording element substrates are disposed, and that has the same width as a recording medium to achieve further high-speed recording.

As shown in FIGS. 12 and 13, the recording head, for example, of a full-line type, has a plurality of recording element substrates 1100*a* to 1100*d* disposed on a main surface of a single supporting plate 1200. Each recording element substrate is electrically connected with an electric wiring member 1300.

This supporting plate 1200 is joined to and held by an ink supplying member 1500 and constitutes an ink jet recording head 1000. In the ink supplying member 1500 is formed a liquid chamber for supplying ink to the recording element substrates.

Japanese Patent Laid-Open No. 2007-290245 describes a full-line type recording head in which a plurality of liquid chambers are formed in an ink supplying member 1500 to facilitate the removal of bubbles.

In general, members constituting a recording head may differ from each other in characteristics and function, and therefore also differ from each other in linear expansivity.

Specifically, recording element substrates 1100 each having an ejection port group for ejecting ink may be formed of silicon, which has a relatively low linear expansivity.

The recording element substrates 1100 are supported by, and fixed to, a supporting member. When the temperature changes, the difference in linear expansivity between the supporting member and the recording element substrates 1100 can cause warping. Reducing such warping can prevent the recording element substrates from being deformed or damaged. Therefore, the supporting member may be formed of a material that has a relatively high rigidity and a linear expansivity that is close to the linear expansivity of the recording element substrates 1100, such as for example a ceramic material.

An ink supplying member supplies liquid such as ink to the recording element substrates through the supporting member. The ink supplying member has a flow passage and a liquid chamber for supplying ink to the recording element substrates, and a shape adapted for fixing of the recording head to the recording apparatus. Therefore, the ink supplying member may be formed of resin by injection molding, which method may provide a relatively high degree of freedom of the member shape. The supporting member and the ink supplying member are joined, for example, with an adhesive.

In the case of the above recording head, the linear expansivity of the liquid supplying member formed of resin is relatively large compared to the linear expansivity of the recording element substrates and the supporting member formed of metal or ceramic.

In the case of serial-scan-type recording heads, which typically are not very long in size, if warping attributed to the difference in linear expansivity occurs when temperature changes, recording is generally not affected.

However, in the case of full-line type recording heads, the recording heads may be relatively long-sized in the longitudinal direction compared to serial scan type recording heads, and therefore warping attributed to the difference in linear expansivity among members may be significant. Therefore, problems caused by the warping can affect the recording.

The temperature change causing the above-described warping can occur in the recording head during either the assembly of the recording head, or during the use of the recording apparatus.

In general, when bonding members together that have significantly different linear expansivities, a flexible adhesive may be used to mitigate the effect of the warping. Most flexible adhesives are capable of bonding at room temperature, and therefore the temperature change during assembly may not be a problem.

However, when bonding members together that have significantly different linear expansivities and that are also relatively long-sized, the adhesive may not be able to absorb the warping caused by the temperature change of the recording head during the use of the recording apparatus, even when a flexible adhesive capable of bonding at room temperature is used. Therefore, the bonding strength may decrease, and peeling may occur.

When the recording head is assembled using an adhesive capable of bonding at high temperature, the temperature change of the recording head from the high temperature provided during the assembly process, back to room temperature, may create warping issues. An example of the warping attributed to a difference in linear expansivities between members that expand or contract due to temperature change, will be qualitatively described with reference to FIGS. 14A to 14C.

In FIG. 14A, the center in the longitudinal direction of the recording head is the origin, the direction of arrows represents the direction of displacement, and the length of arrows represents the magnitude of displacement. The longitudinal direction of the recording head is parallel to the longitudinal direction of the supporting member 1200. With the increasing distance from the center (origin) in the longitudinal direction of the recording head (in the longitudinal direction of the supporting member 1200), that is, with the decreasing distance from each end, the magnitude of displacement during expansion or contraction increases, and therefore the amount of the warping attributed to the difference in linear expansivity also increases. When the supporting member 1200 and the liquid supplying member 1500 are bonded at high temperature (FIG. 14A), the liquid supplying member 1500 contracts more significantly than the supporting member 1200 in the process of cooling to room temperature, and therefore warping may occur (FIG. 14B). The warping may cause the supporting member 1200 to peel off the liquid supplying member 1500 at each end (FIG. 14C).

If warping occurs and the supporting member 1200 is deformed as shown in FIG. 14B, the accuracy in placement of the recording element substrates is reduced, and thus the recording quality may be affected, even if the amount of deformation is small. In addition, the ink supplying member 1500 itself may be unacceptably deformed.

Also, if peeling occurs at each end as shown in FIG. 14C, it can significantly affect the recording operation.

SUMMARY OF THE INVENTION

According to one aspect of the present invention, a liquid ejection head is provided that includes at least one liquid ejecting substrate for ejecting liquid, a supporting member for supporting the at least one liquid ejecting substrate, the at least one liquid ejecting substrate being fixed to a main surface of the supporting member, and a plurality of liquid supplying members for supplying liquid to the at least one liquid ejecting substrate through the supporting member. A linear expansivity of each of the liquid supplying members is different from a linear expansivity of the supporting member. The plurality of the liquid supplying members are arranged along a longitudinal direction of the supporting member, with each of the liquid supplying members being bonded to a surface that is opposite the main surface of the supporting member.

In another aspect according to the present invention, a recording apparatus is provided that includes the liquid injection head described above, wherein the recording apparatus performs recording on a recording medium using the liquid ejection head.

Further features of the present invention will become apparent from the following description of exemplary embodiments with reference to the attached drawings.

DESCRIPTION OF THE EMBODIMENTS

An ink jet recording head (hereinafter referred to as recording head) will be briefly described as an example of a liquid ejection head that may be used in embodiments according to the present invention.

In this specification, the term "recording" is not limited to only the forming of significant information such as characters and graphics. For example, object for recording need not necessarily be significant. Objects for recording need not even necessarily be visible. The term "recording" is defined broadly to include forming an image, a pattern, and so forth on a recording medium as well as processing a medium.

The term "recording medium" is not limited to paper, which may be used in a recording apparatus, but may also include anything capable of receiving ink, for example, cloth, a plastic film, a metal plate, glass, ceramics, wood, and leather.

As with the above term "recording," the term "ink" is to be understood to have a broad meaning. The term may include liquid that is applied to a recording medium for forming an image, a pattern, and so forth, as well as liquid applied in processing a recording medium, or processing ink. Therefore, the term "ink" can include all liquids that can be used for recording.

Figure 1:
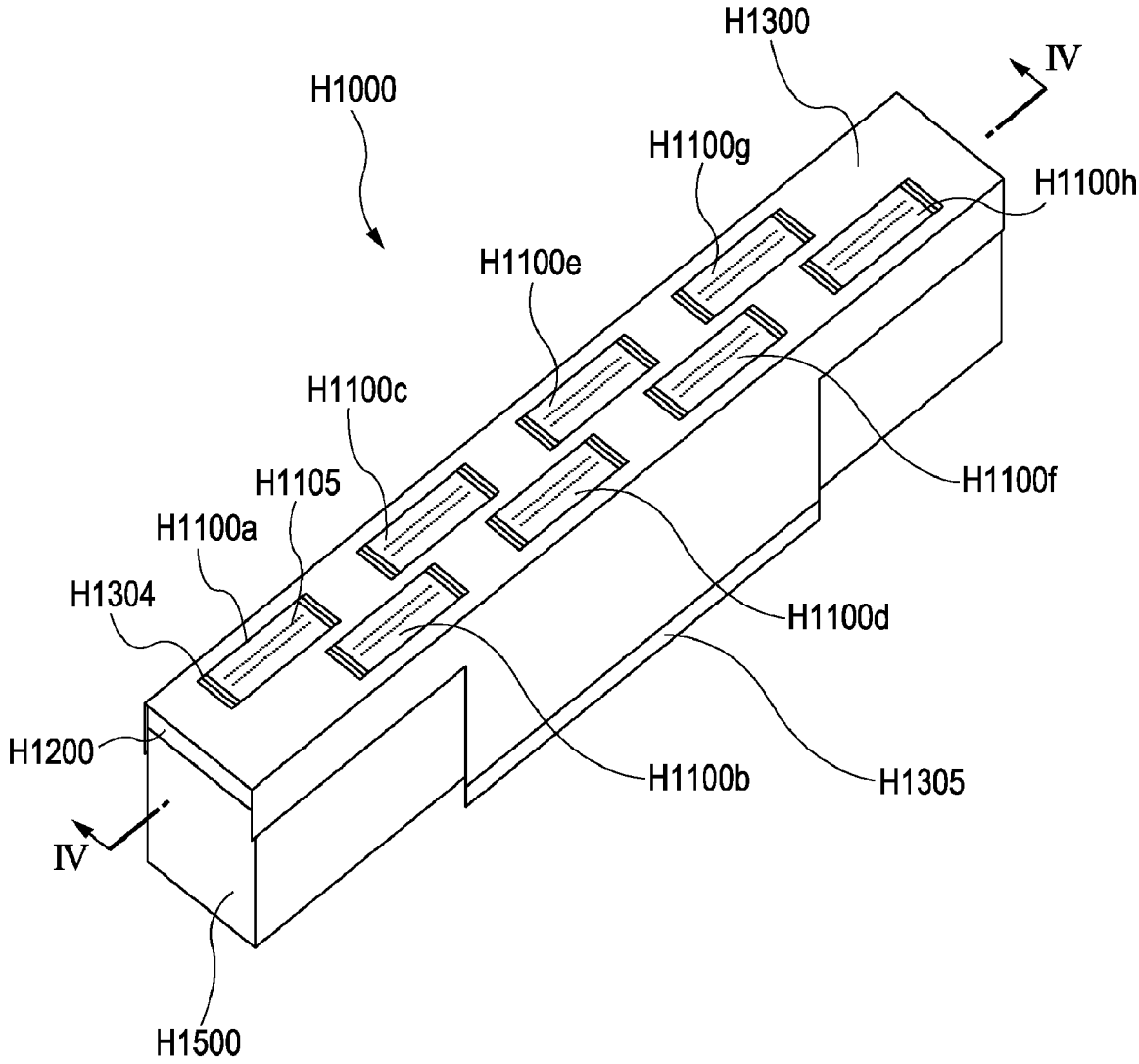
FIG. 1 illustrates an embodiment of an ink jet recording head.
Figure 2:
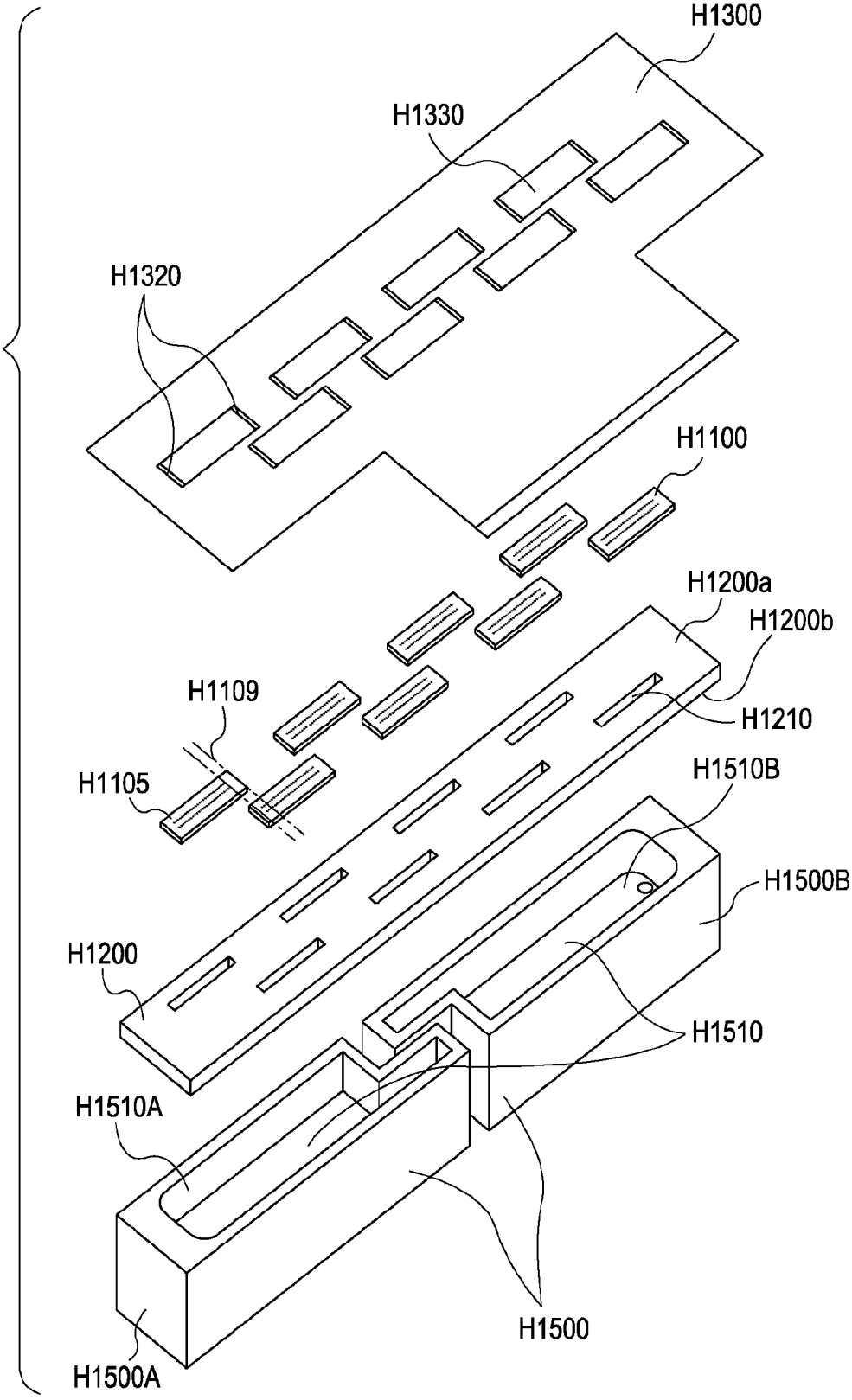
FIG. 2 is an exploded perspective view of an ink jet recording head according to an embodiment.

FIGS. 1 and 2 illustrate an embodiment of a recording head according to aspects of the present invention. FIG. 1 is a schematic perspective view showing an embodiment of a recording head. FIG. 2 is an exploded perspective view showing the configuration of the recording head H1000 of FIG. 1.

The recording head according to this embodiment includes at least one and even a plurality of recording element substrates H1100 (i.e., liquid ejecting substrates), a supporting plate H1200 (i.e., supporting member) for supporting the recording element substrates, an electric wiring substrate H1300 for electrically connecting the recording element substrates with a recording apparatus, and a plurality of ink supplying members H1500 (i.e., liquid supplying members) bonded to the supporting plate (see, e.g., FIG. 2). The ink supplying members H1500 may supply liquid to the recording element substrates H1100 through the supporting plate H1200. On a main surface H1200*a* (i.e., top surface) of the supporting plate H1200 are disposed the recording element substrates H1100. On the opposite surface H1200*b*, which surface is on the side of the supporting plate H1200 that is opposite the main surface H1200*a*, are disposed the ink supplying members H1500. The supporting plate H1200 is elongate in the longitudinal direction of the recording head.

A description will be given of an embodiment of the recording element substrates, each of which serves as a liquid ejecting substrate having an ejection port group for ejecting liquid. According to this embodiment, the recording element substrates H1100*a* to H1100*h* as shown in FIG. 1 each have heaters serving as recording elements that generate energy for ejecting ink. The recording element substrates H1100*a* to H1100*h* each have an ejection port group H1106 comprising a plurality of ejection ports H1105 that correspond to the respective heaters, and that may be formed and arranged in lines (see, e.g., FIG. 3A).

As shown in the embodiment of FIG. 2, the supporting plate H1200, which serves as a supporting member that supports the recording element substrates H1100, has ink supply paths H1210 for supplying ink to the recording element substrates H1100. The recording element substrates H1100 may be disposed and fixed on the main surface H1200*a* of the supporting plate H1200 with a predetermined positional accuracy. By disposing a plurality of recording element substrates on a single supporting plate having a relatively low linear expansivity, a continuous array of ejection ports can be formed with a fairly high degree of accuracy, even in a recording head having a relatively long size.

According to this embodiment, the recording element substrates H1100 may be arranged in such a manner that the ejection port groups H1106 provided in the recording element substrates overlap at their ends H1109 (see, e.g., FIG. 2) in the direction in which the ejection ports are arranged. By arranging the recording element substrates H1100 on the supporting plate H1200 in such a staggered manner, a continuous array of ejection ports H1105 may be formed in the longitudinal direction of the recording head, that is, the longitudinal direction of the support plate H1200. By overlapping the recording element substrates H1100 at their ends H1109 as described above, the effect of an error in arrangement of the recording element substrates H1100 on an image during recording can be corrected.

In one version, the supporting plate H1200 may be formed of a ceramic material, such as for example an alumina ($Al_2O_3$) material 0.5 to 10 mm thick, to provide strength. However, the material of the supporting plate H1200 is not limited to an alumina material. The supporting plate H1200 may be formed of any material having a relatively low linear expansivity and a relatively high rigidity. Examples of such a material include, but are not limited to, silicon (Si), aluminum nitride (AlN), zirconia ($ZrO_2$), silicon nitride ($Si_3N_4$), silicon carbide (SiC), molybdenum (Mo), and tungsten (W). In one version the supporting plate H1200 is a single member (i.e., a unitary member formed of a single material).

As shown in the embodiment of FIG. 2, the electric wiring substrate H1300 has openings H1330 formed therein corresponding to the positions where the recording element substrates H1100 are fixed. The electric wiring substrate H1300 may be bonded and fixed to the supporting plate H1200 so that the recording element substrates H1100 are fitted in the openings H1330. The electric wiring substrate H1300 can supply an electric signal and electric power for driving the heaters of the recording element substrates H1100.

Figure 3A:
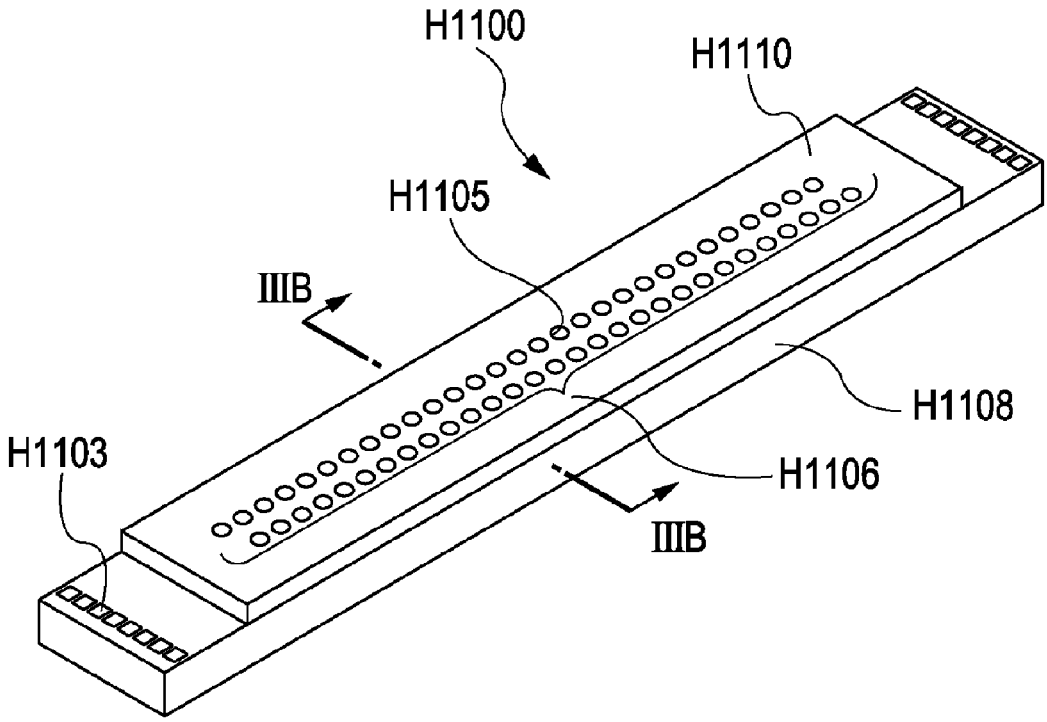
FIGS. 3A and 3B illustrate an embodiment of a recording element substrate.
Figure 3B:
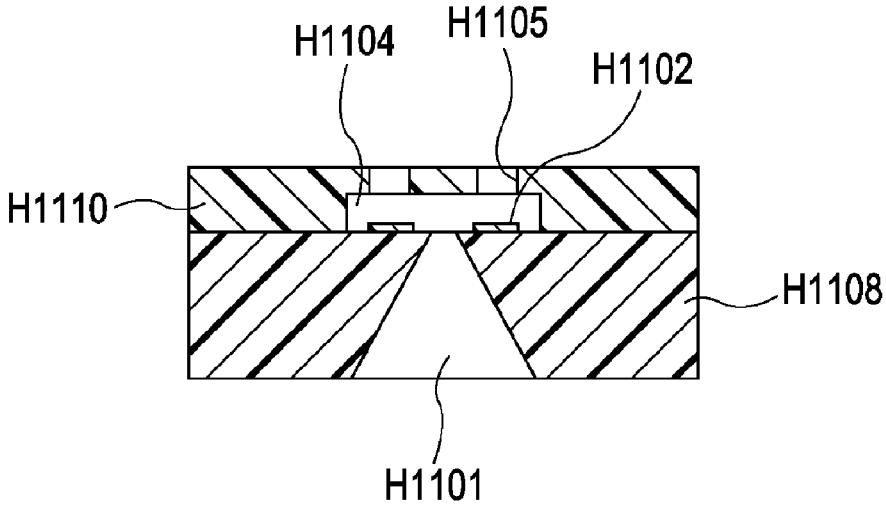

FIG. 3A illustrates the configuration of an embodiment of the recording element substrates H1100. FIG. 3B is a sectional view taken along line IIIB-IIIB of FIG. 3A.

As shown in the embodiments of FIGS. 3A and 3B, the recording element substrates H1100 each have an ejection port group H1106 that comprises a plurality of ejection ports H1105 for ejecting ink, and an ink supply port H1101 that communicates with the ejection ports for supplying ink to the ejection ports. According to this embodiment, each ejection port group H1106 is formed in an ejection port forming member H1110, and the ink supply port H1101 is formed in a silicon substrate H1108.

The silicon substrate H1108 according to this embodiment has a thickness of 0.5 mm to 1.0 mm, and has an ink supply port H1101 formed therein by anisotropic etching. In the silicon substrate H1108 are formed heaters H1102 and a drive circuit for driving the heaters. The silicon substrate H1108 is provided with electrical connecting terminals H1103 for transmitting an electric signal and electric power to be supplied to the drive circuit. In the ejection port forming member H1110, an ink flow passage H1104 and ejection ports H1105 are formed using a photolithographic technique, so that the heaters H1102 correspond to the ejection ports H1105.

As shown in the embodiment of FIG. 1, the electrical connecting terminals H1103 are electrically connected with connecting terminals H1320 (see, e.g., FIG. 2) formed on the surface of the electric wiring substrate H1300, for example, by wire bonding. These electrical connection parts are sealed with sealant H1304 (see, e.g., FIG. 1) to prevent ink erosion and damage by external force. A connector portion H1305, which is a part of the electric wiring substrate H1300 and is for exchanging electric signals with the outside, is bent and fixed to the ink supplying members H1500 to facilitate connection with the recording apparatus.

According to this embodiment, the ink supplying members H1500 each have an ink supply chamber H1510 formed therein and serving as a flow passage. The ink supplying members H1500 are formed of a resin material, for example, by injection molding, in which the shape degree of freedom is high.

As described above, in a recording head to which the present invention can be applied, a supporting plate H1200 may be formed of a metal or a ceramic material that has a relatively low linear expansivity and a relatively high rigidity. To this supporting plate H1200, which has a relatively low linear expansivity, are bonded ink supplying members H1500 formed of a resin material, which generally has a relatively high linear expansivity.

Next, embodiments of the configurations of the ink supplying members H1500, according to aspects of the present invention, will be described in detail with reference to FIG. 2 and FIGS. 4 to 10.

In a first embodiment, the supporting plate H1200 of the recording head measures about 5 inches in length (4 inches (the recording width)+1 inch (the area for the electric wiring substrate)).

Figure 4:
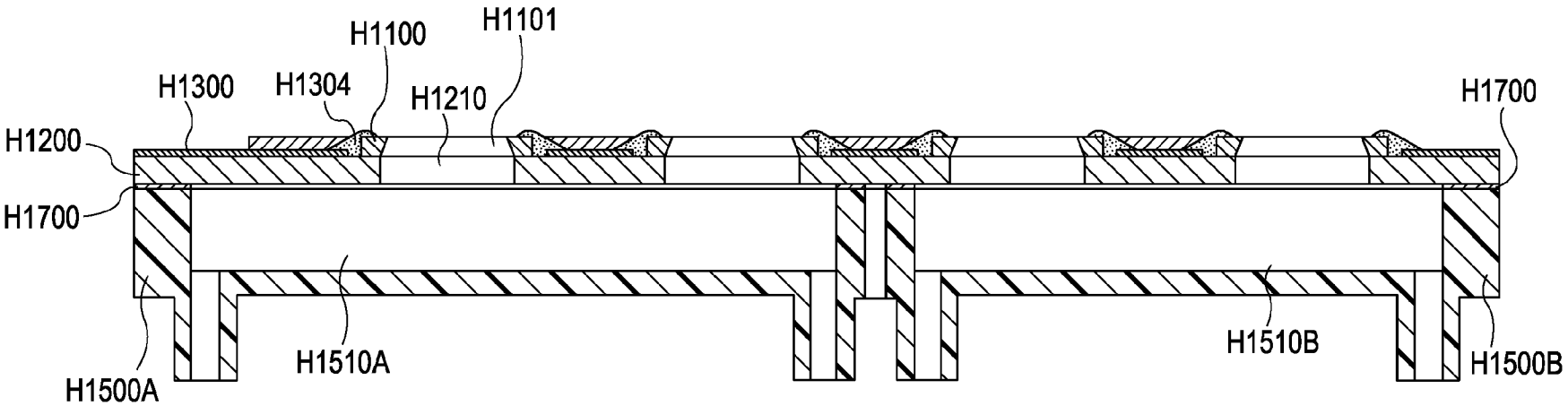
FIG. 4 is a sectional schematic view taken along line IV-IV of FIG. 1.

As shown in FIGS. 2 and 4, two ink supplying members H1500A and H1500B that are each about half the length of the supporting plate H1200, which is 5 inches in length, in the longitudinal direction of the supporting plate H1200, are bonded to the opposite surface H1200*b* of the supporting plate H1200.

Figure 12:
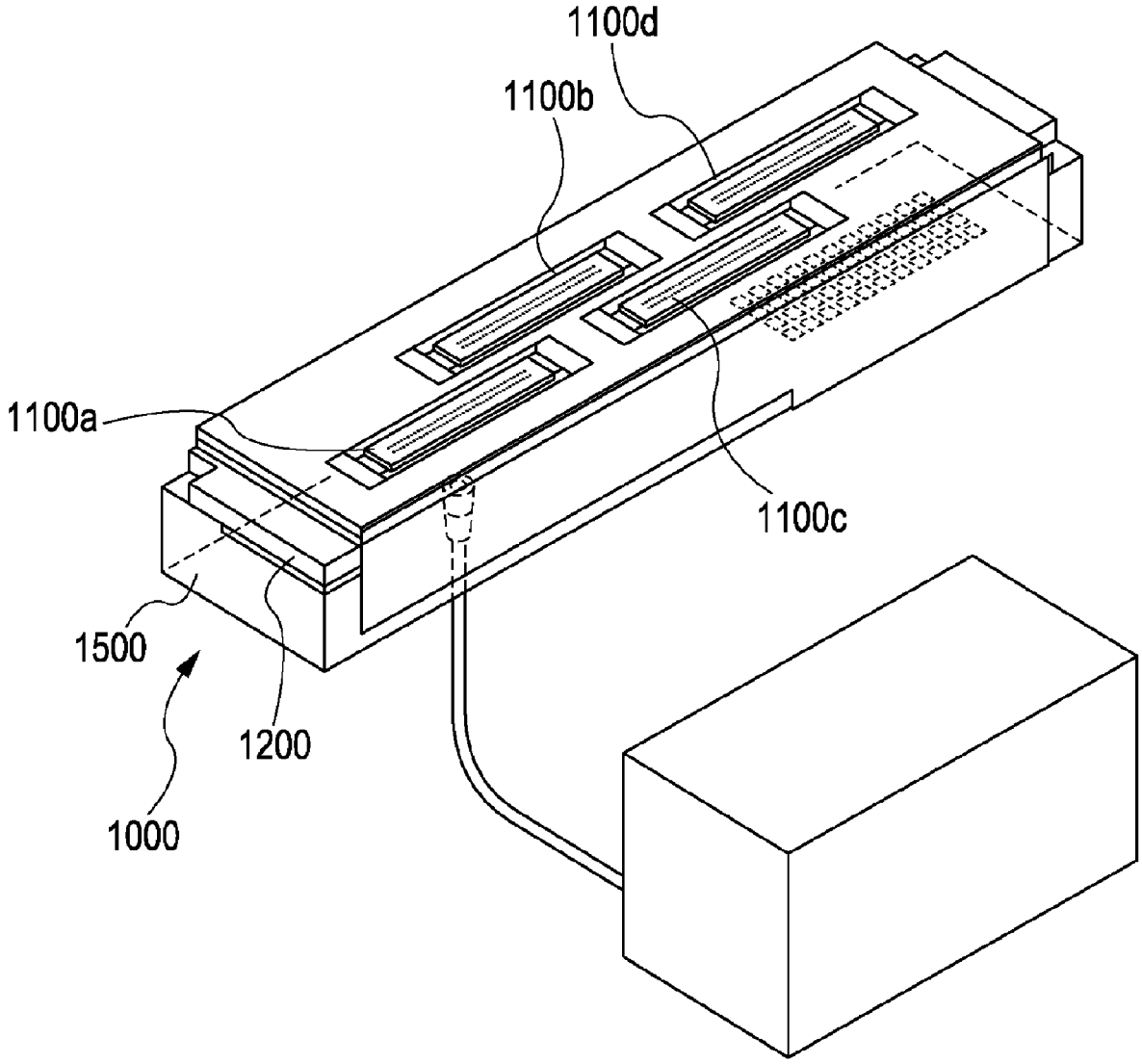
FIG. 12 illustrates a full-line type ink jet recording head.

In this embodiment, the length of each ink supplying member H1500 in the longitudinal direction is about half the length of a conventional ink supplying member 1500 (see, e.g., FIG. 12).

Figure 14A:
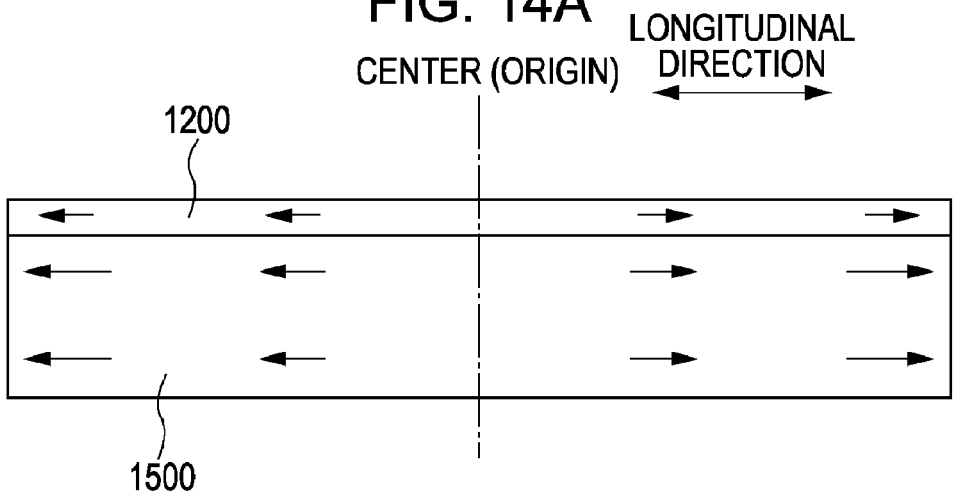
FIGS. 14A to 14C illustrate warping that can be caused by temperature change and that is attributed to a difference in linear expansivity.
Figure 14B:
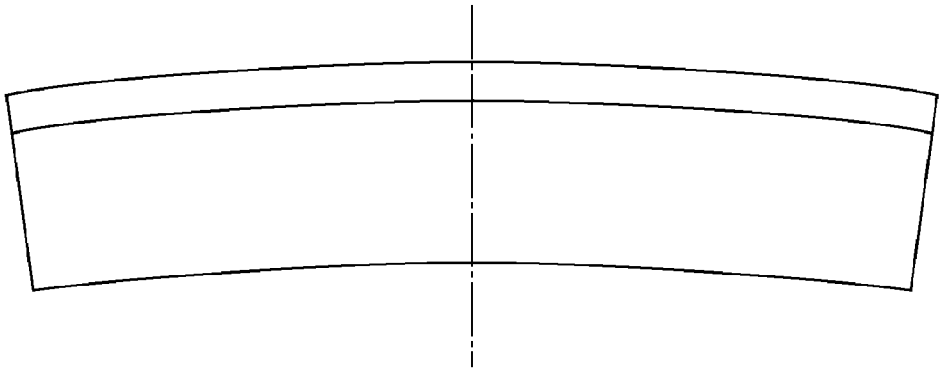
Figure 14C:
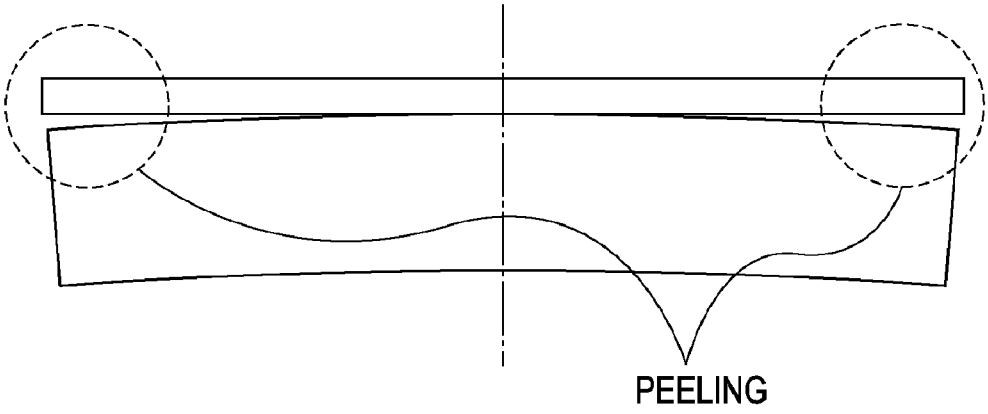

Therefore, the amount of the warping described with reference to FIGS. 14A to 14C, and attributed to the difference in linear expansivity and caused by temperature change, can be reduced to half of that in the case of FIG. 12. Therefore, the warping of the supporting plate H1200 and the ink supplying members H1500 can be lessened. In addition, the possibility that peeling of the supporting plate H1200 occurs at each end of each ink supplying member H1500 can be reduced.

According to one embodiment, to bond the supporting plate H1200 and the ink supplying members H1500, an adhesive H1700 (see, e.g., FIG. 4) that hardens at high temperature and has a high elastic modulus may be used.

For bonding together members that are significantly different in linear expansivity, an adhesive that forms a flexible bonding layer may be used. The reason for this is that a flexible bonding layer may be capable of absorbing and easing the warping caused by the difference in linear expansivity between the members.

However, according to the configuration of the embodiment of present invention, the amount of the warping caused by the difference in linear expansivity in the longitudinal direction of the supporting plate is relatively small, and therefore both an adhesive that forms a bonding layer having a relatively low elastic modulus, as well as an adhesive that forms a bonding layer having a relatively high elastic modulus, can be used as the adhesive H1700.

Considering the bonding strength, chemical resistance to ink, and so forth of the bonding layer, the adhesive used may be one that forms a bonding layer having a relatively high elastic modulus. In the case of an adhesive that forms a bonding layer having a relatively high elastic modulus, the bonding layer may often harden at higher temperatures, and therefore the temperature may significantly change during assembly. However, even in the case of such a significant temperature change, the effect of the warping attributed to the difference in linear expansivity can be reduced with embodiments according to aspects of the present invention.

When the ink supplying members H1500 expand with increasing temperature, and when the ink supplying members H1500 are disposed so as to be in contact with each other, there is a possibility that the bonding layer between the supporting plate H1200 and the ink supplying members H1500 is subjected to stress. Therefore, in one version, the ink supplying members H1500 bonded to the supporting plate H1200 may be disposed so as not to be in contact with each other at room temperature, and may even be disposed so as not to come into contact with each other even if a rise in temperature occurs during use of the recording head. The ink supplying members bonded to the supporting plate H1200 may also achieve an effect in accordance with aspects of the present invention if they have little interaction with each other when expanding or contracting with temperature change. Therefore, in certain versions, the ink supplying members need not necessarily be separate from each other, as in the configuration of this embodiment.

As described above, by arranging a plurality of ink supplying members H1500 along the longitudinal direction of the supporting plate H1200, and bonding the ink supplying members H1500 to the supporting plate H1200, the warping of the supporting plate H1200 and the ink supplying members H1500 in the longitudinal direction of the supporting plate H1200 can be lessened. The first embodiment thus provides a liquid ejection head in which warping attributed to the difference in linear expansivity between constituent members is lessened. That is, a liquid ejection head can be provided in which the warping in the longitudinal direction of the supporting member attributed to the difference in linear expansivity between the supporting member and the liquid supplying member is lessened. Therefore, a recording head capable of generally stable and high-quality recording can be provided.

Figure 5:
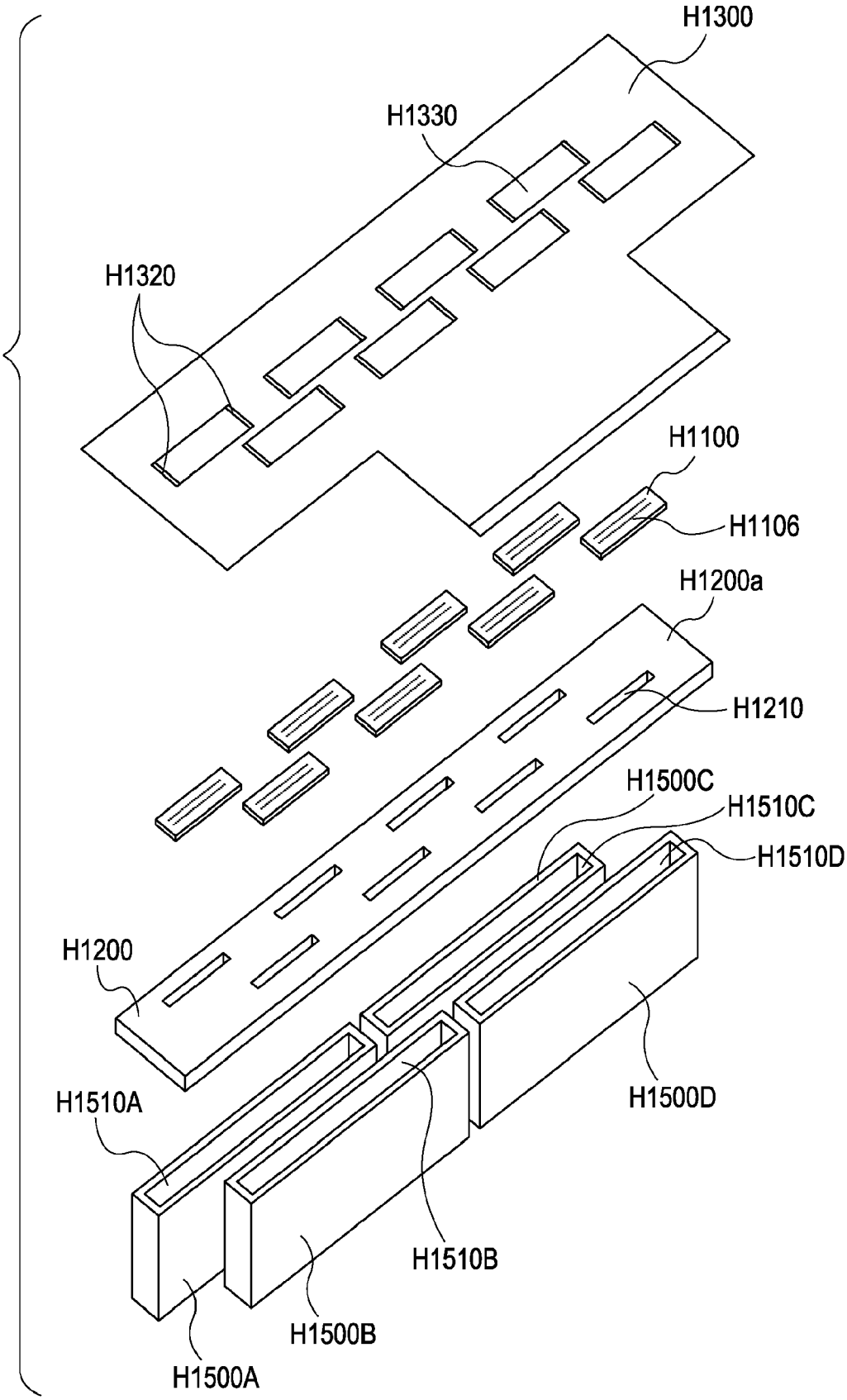
FIG. 5 is an exploded perspective view of an ink jet recording head according to a first modification of a first embodiment.

A description is given above of the first embodiment having a configuration in which two ink supplying members H1500A and H1500B are disposed in a recording head, as shown in FIGS. 2 and 4. In a first modification thereof, as shown in FIG. 5, four ink supplying members H1500A to H1500D (two in the longitudinal direction of the supporting plate H1200 and two in the direction perpendicular to the longitudinal direction) that have ink supply chambers H1510A to H1510D, respectively, formed therein, may be disposed in the recording head. The recording head thus has ink supplying members H1500A to H1500 D arranged along a longitudinal direction thereof, with at least a portion of the plurality of ink supplying members also being arranged along a direction perpendicular to the longitudinal direction.

Figure 6:
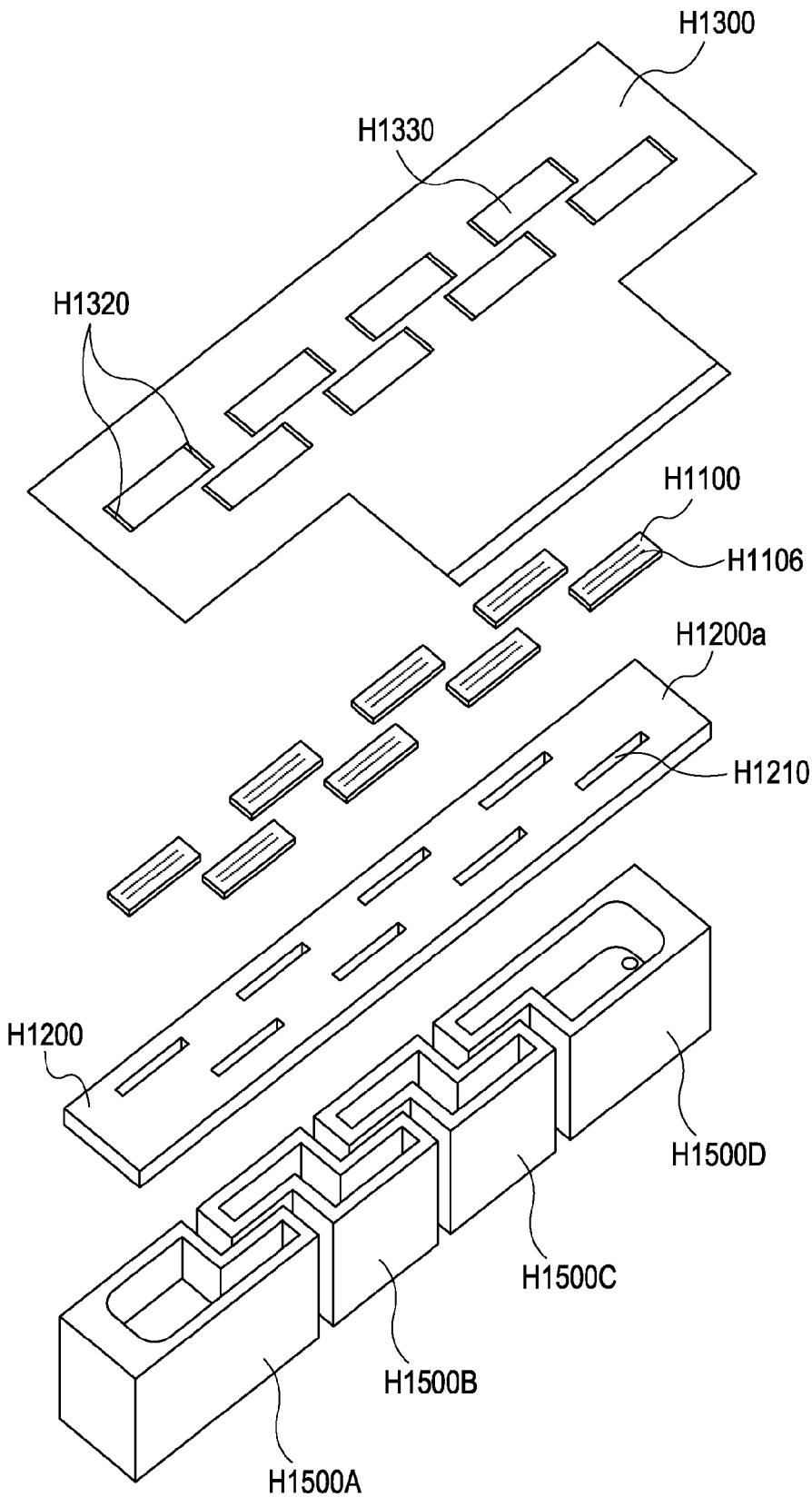
FIG. 6 is an exploded perspective view of an ink jet recording head according to a second modification of a first embodiment.
Figure 7:
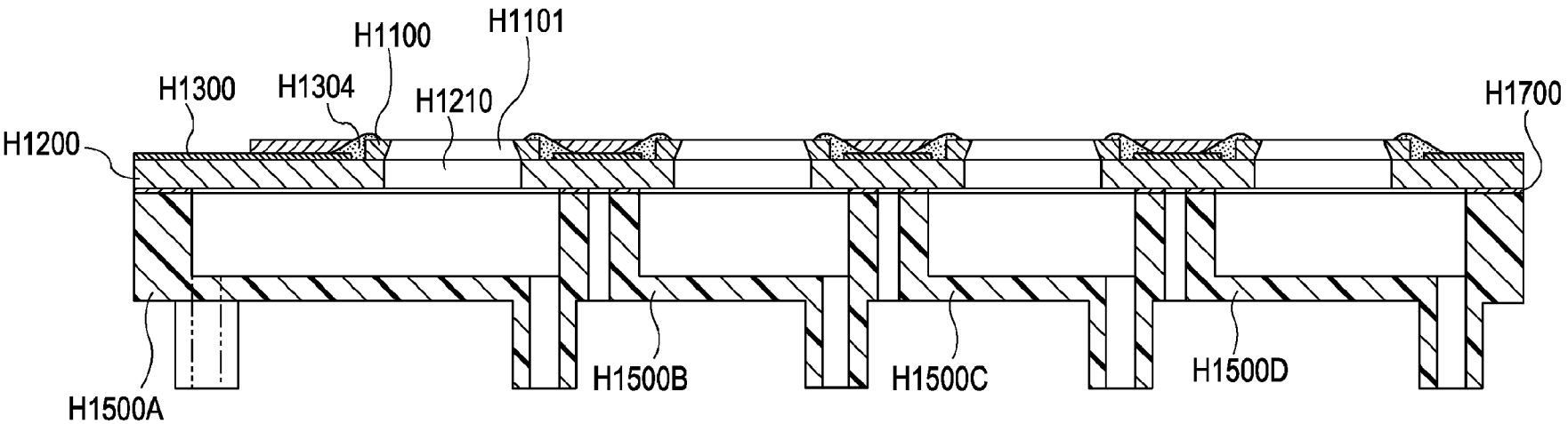
FIG. 7 is a sectional schematic view of an ink jet recording head according to a second modification of a first embodiment.

In a second modification of the first embodiment, in the case of a recording head having a recording width of 8 inches, 12 inches, or more, four ink supplying members H1500A to H1500D may be disposed in the longitudinal direction of the supporting plate H1200, as shown in FIGS. 6 and 7.

Figure 8:
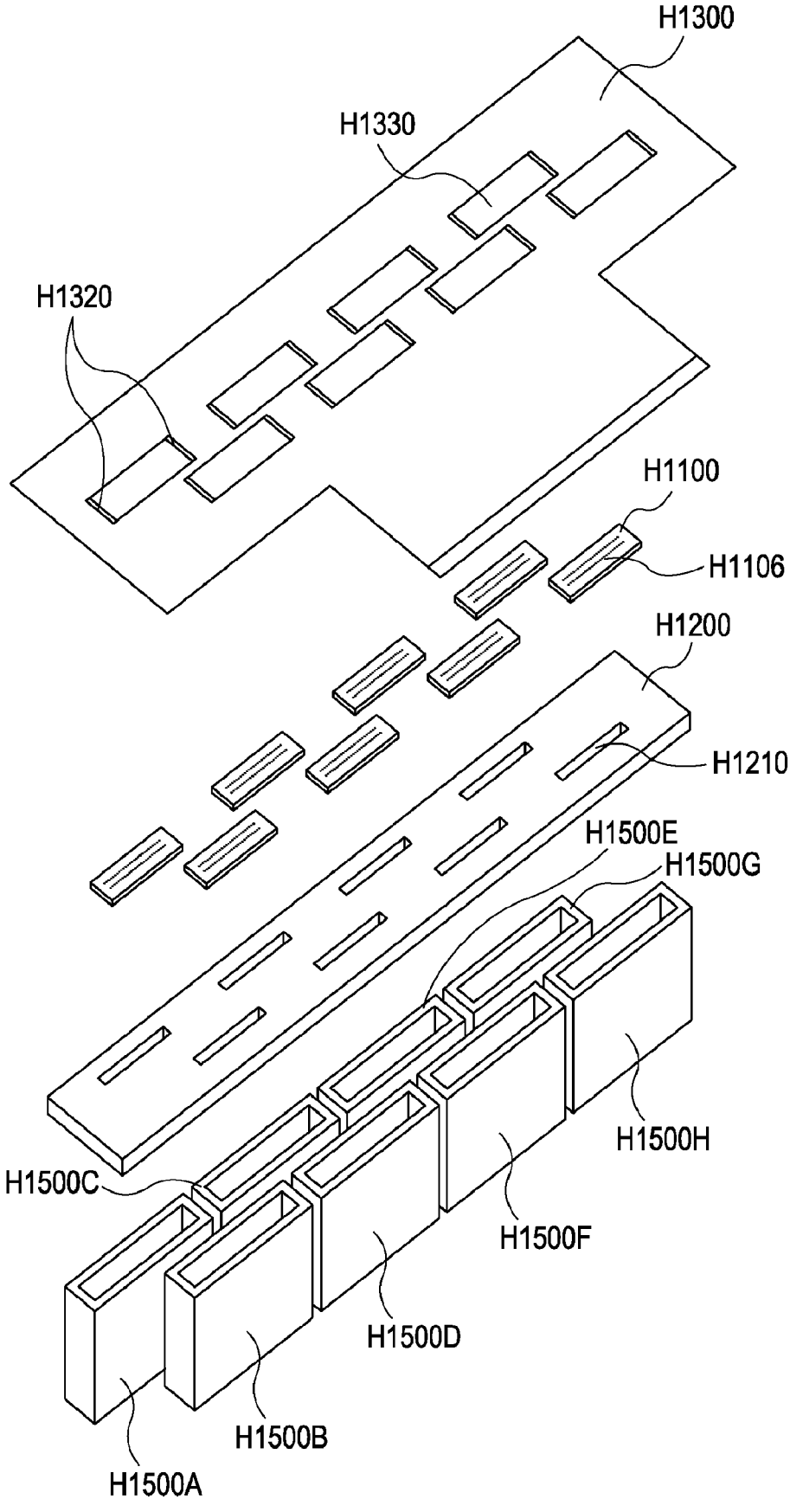
FIG. 8 is an exploded perspective view of an ink jet recording head according to a third modification of a first embodiment.
Figure 9:
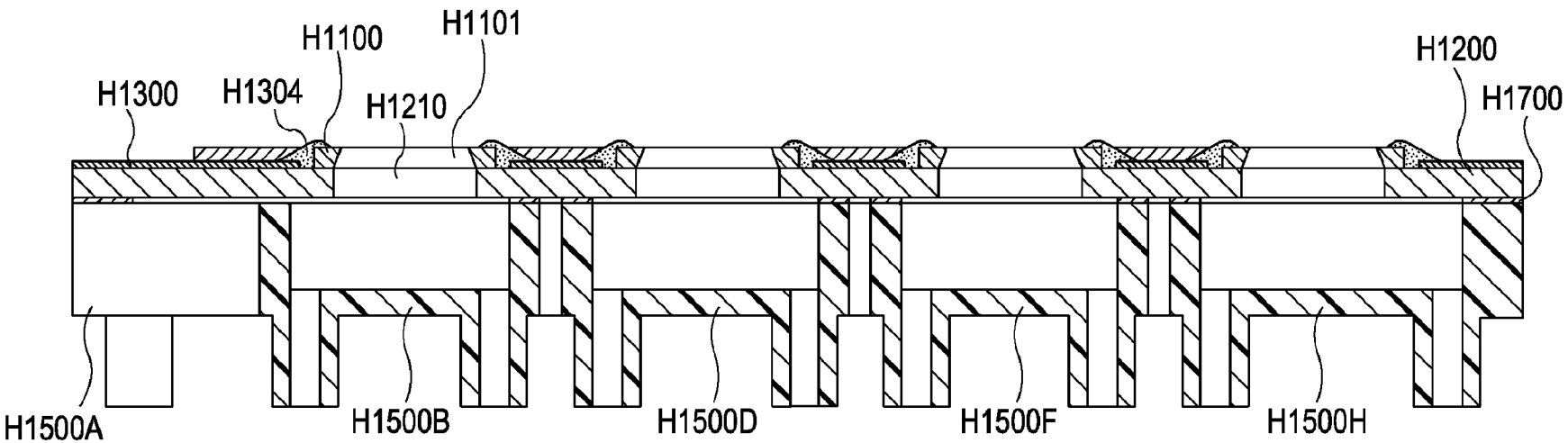
FIG. 9 is a sectional schematic view of an ink jet recording head according to a third modification of a first embodiment.

In a third modification of the first embodiment, as shown in FIGS. 8 and 9, by using ink supplying members H1500A to H1500H, each corresponding to a respective recording element substrate H1100, the warping attributed to the difference in linear expansivity in the longitudinal direction of the supporting plate H1200 can be further lessened. In addition, as shown in FIG. 8, a plurality of the ink supplying members, for example, H1500A and H1500B, are provided with respect to the direction perpendicular to the longitudinal direction of the supporting plate H1200. Therefore, with respect to the direction perpendicular to the longitudinal direction, the warping attributed to the difference in linear expansivity can also be lessened.

In the first to third modifications described above, each ink supplying member H1500 is relatively short compared to the first embodiment in the longitudinal direction of the supporting plate H1200, as well as in the direction perpendicular to the longitudinal direction, and therefore the warping attributed to the difference in linear expansivity can be further lessened.

Furthermore, in the case of a recording head having a large recording width, the ink supplying member H1500 provided therein may be elongate and relatively large, and therefore such a recording head may not only warp due to the difference in linear expansivity between the supporting plate H1200 and the ink supplying member H1500, but may also exhibit the following. When the ink supplying member H1500 is relatively large, it can be difficult to uniformly and stably supply ink to the recording element substrates H1100, and to perform a recovery operation for removing bubbles in the flow passages from the ink supply chamber to the ejection ports of the recording element substrates H1100. The recovery operation may be an operation of forcing ink to flow from the ink supply chamber in the ink supplying member H1500 into the recording element substrates H1100.

Such issues may be at least partially resolved by using relatively short and small, and even the shortest and smallest possible ink supplying members H1500, when using a recording head having a relatively large recording width, as in the first embodiment and the first to third modifications thereof.

When, in a recording head having a relatively large recording width, where the recording elements comprise heaters such as heating resistance elements, it may be that the recording quality is affected by the temperature change of the recording element substrates. In general, with a temperature change of the recording element substrates, the amount of ejected ink changes and the recording density also changes.

Therefore, in a recording head that has a plurality of recording element substrates, as in the first embodiment and the first to third modifications thereof, recording may be performed in a manner so as to reduce the temperature differences among the recording element substrates.

The recording head of the present invention may also be suitable for performing recording so as to reduce the temperature differences among the recording element substrates in a configuration in which ink is supplied to the ink supplying members from outside the recording head.

In each of the configurations of the first embodiment and the first to third modifications thereof, a recording head is provided with a plurality of ink supplying members. Therefore, in these configurations, unlike a configuration in which a recording head has a single ink supplying member, it is possible that the temperature of ink in the ink supply chambers H1510 may be maintained constant by supplying fresh ink to the ink supply chambers H1510. Therefore, the temperature of the recording element substrates H1100 can be equalized by supplying ink through the supporting plate H1200.

In each of the first embodiment and the first to third modifications thereof, the ink supply chambers H1510 of the ink supplying members H1500 are supplied with ink from an ink tank serving as a liquid supply source. Additionally or alternatively, the ink supplying members H1500 may be capable of functioning as a tank that contains ink, and/or a member or mechanism for generating negative pressure in the ink supply chambers H1510 may be provided.

A second embodiment according to aspects of the present invention will be described with reference to FIG. 10.

Figure 10:
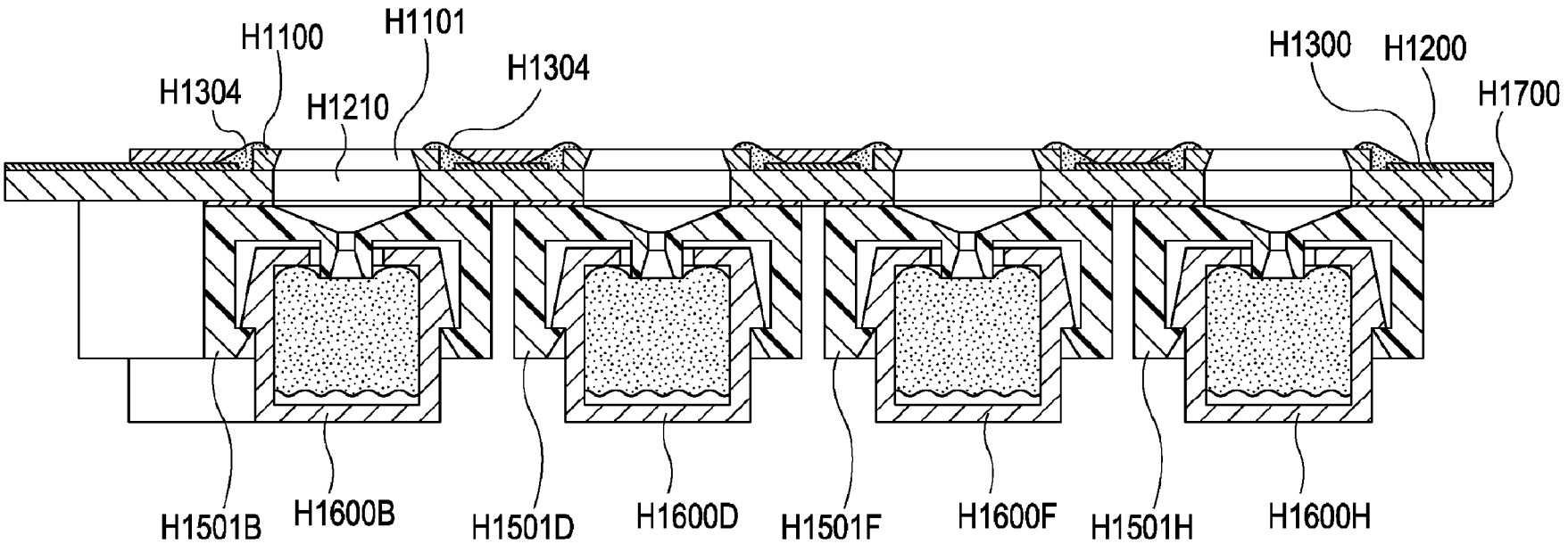
FIG. 10 is a sectional schematic view of an ink jet recording head according to a second embodiment.

FIG. 10 is a sectional view of a recording head according to the second embodiment, taken along the longitudinal direction of the supporting plate H1200.

The same reference numerals will be used to designate the same components as those in the first embodiment, so that redundant description thereof is omitted.

In this embodiment, each ink supplying member has a tank-holder shape, that is, is capable of detachably holding an ink tank so that ink tanks H1600A to H1600H containing ink can be detachably attached to the recording head.

Figure 13:
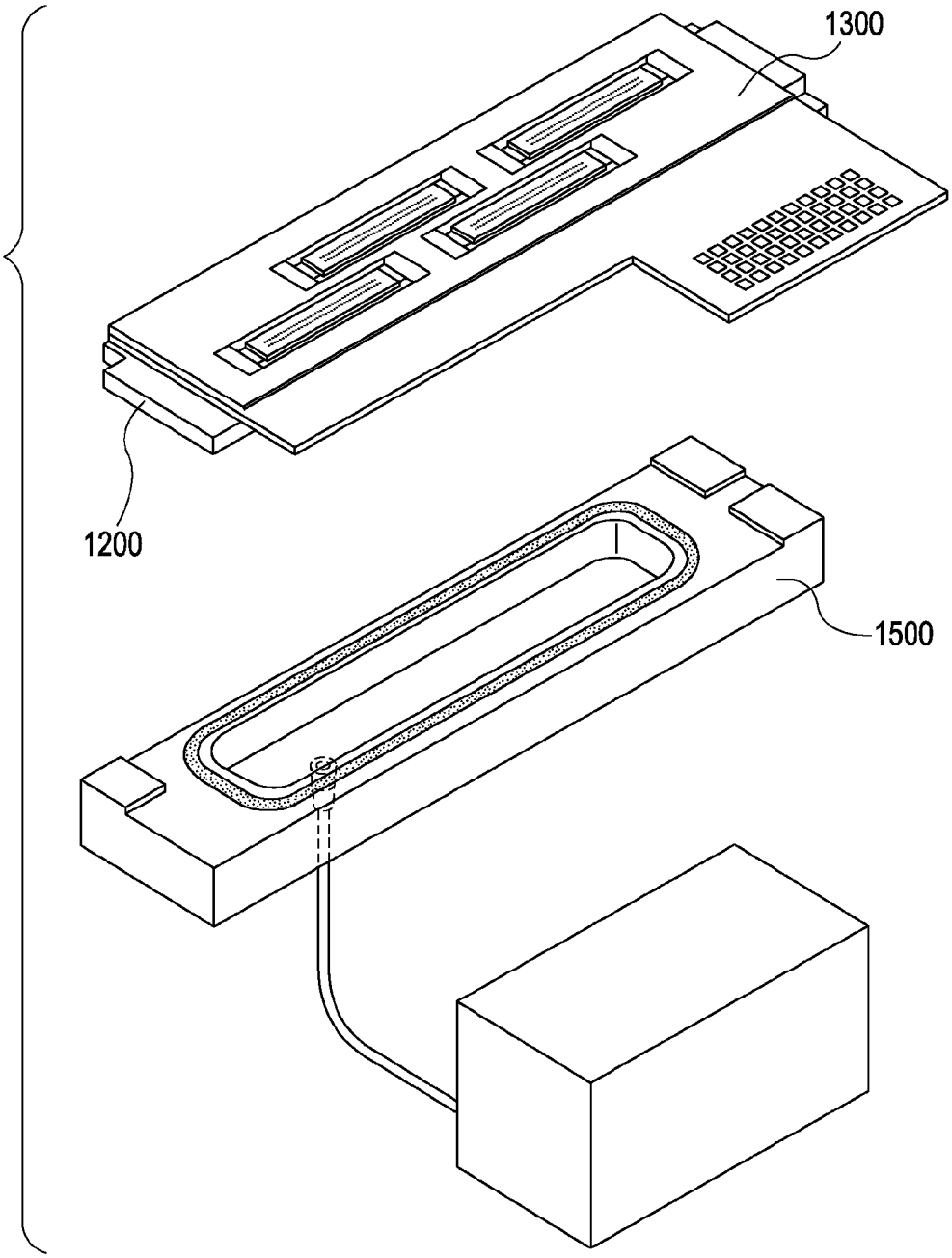
FIG. 13 is an exploded perspective view of a full-line type ink jet recording head.

As shown in the embodiment of FIG. 10, the plurality of ink supplying members H1501A to H1501H are individually bonded to the supporting plate H1200 as in the first embodiment. Therefore, in this recording head, the amount of the warping attributed to the difference in linear expansivity is relatively small compared to a conventional configuration (see, e.g., FIG. 13).

Providing detachable ink tanks H1600 as in this embodiment may also eliminate the need for an ink supply route from an ink supply source outside the recording head. Therefore, using the recording head of this embodiment can provide a more simply-structured and low-cost ink jet recording apparatus.

According to aspects of the present invention, warping in the longitudinal direction of the supporting plate attributed to the difference in linear expansivity between the supporting plate and the ink supplying members may be curbed. However, in general, the size in the direction perpendicular to the longitudinal direction of the supporting plate is about ⅕ to 1/10 of the size in the longitudinal direction. Therefore, the warping attributed to the difference in linear expansivity in the direction perpendicular to the longitudinal direction of the supporting plate may be comparatively small. Therefore, problems due to the difference in linear expansivity may be less likely, and even extremely unlikely to occur, in the direction perpendicular to the longitudinal direction. Therefore, it is possible that in some versions the curbing of the warping in the direction perpendicular to the longitudinal direction may not be indispensable.

Accordingly, in one version of the configurations of the first and second embodiments and the first to third modifications (FIGS. 2, 5, 6, and 8) thereof described above, the plurality of ink supplying members H1500 disposed on the supporting plate H1200 may be in contact with each other in the direction perpendicular to the longitudinal direction.

As described above, in an embodiment of a configuration in accordance with the present invention, a plurality of liquid supplying members are bonded to a supporting member in the longitudinal direction of a liquid ejection head, and therefore a liquid ejection head can be provided in which the amount of the warping in the longitudinal direction that is attributed to the difference in linear expansivity between a supporting member and liquid supplying members is relatively small.

Next, a description will be given of an embodiment of an ink jet recording apparatus in which recording heads in accordance with aspects of the present invention, such as any of those described in the first and second embodiments and the first to third modifications, can be mounted.

Figure 11:
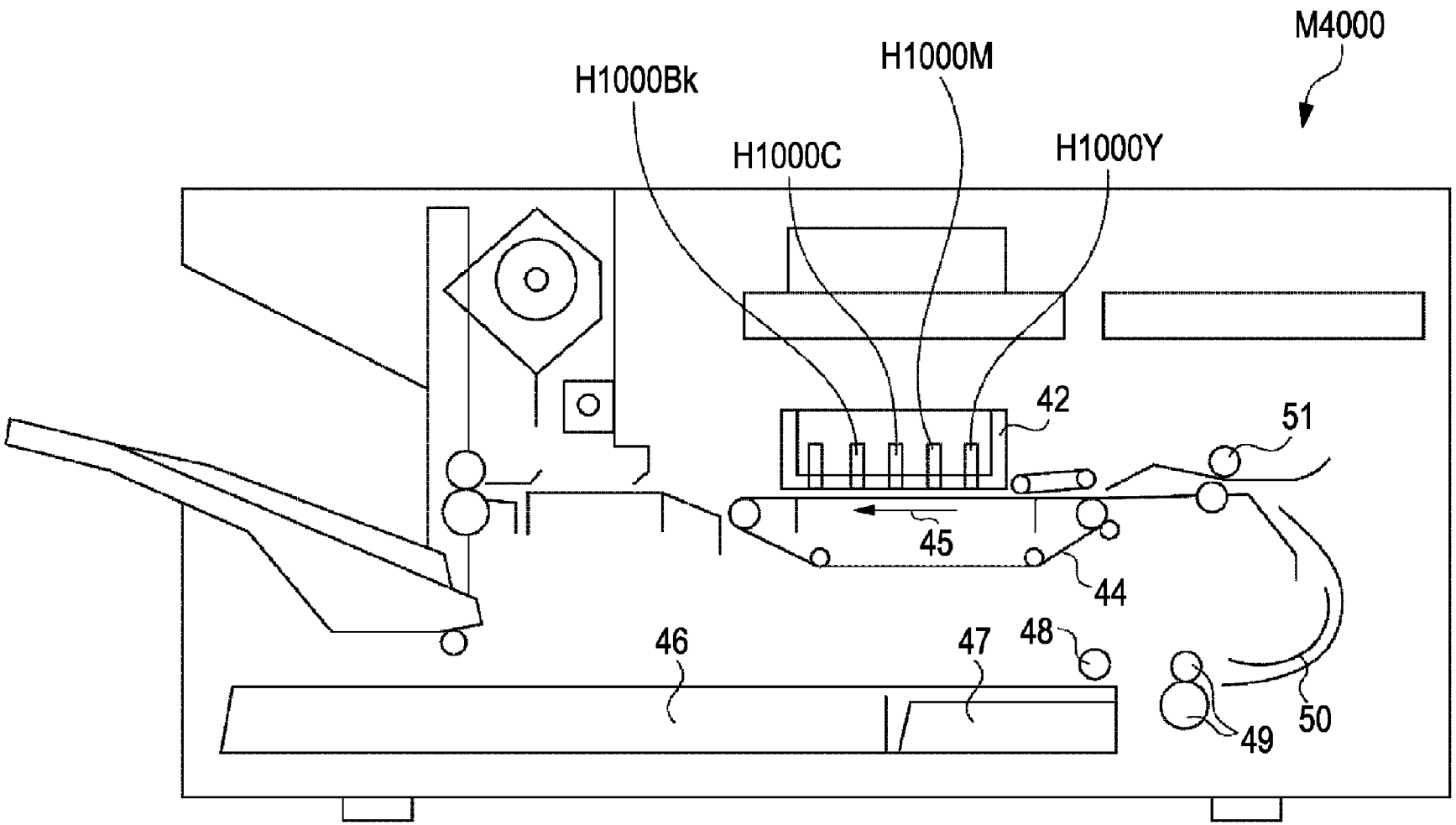
FIG. 11 illustrates an embodiment of a recording apparatus having an ink jet recording head according to an aspect of the present invention.

FIG. 11 is a schematic diagram of an ink jet recording apparatus having recording heads according to an embodiment of the present invention.

In the embodiment of the ink jet recording apparatus M4000 shown in FIG. 11, the recording heads are fixed to the main body of the apparatus, and recording is performed by conveying a recording medium in the direction of an arrow 45.

The ink jet recording apparatus M4000 may have, for example, a recording head H1000Bk for black ink, a recording head H1000C for cyan ink, a recording head H1000M for magenta ink, and a recording head H1000Y for yellow ink. These recording heads H1000Bk to H1000Y can be fixed by a head holder 42 mounted in the ink jet recording apparatus M4000.

Reference numeral 46 denotes a paper cassette in which recording media 47 such as plain paper are housed, and that is detachably attached to the main body of the apparatus. Reference numeral 48 denotes a pickup roller that feeds the uppermost one of the recording media 47.

Reference numeral 49 denotes a conveying roller that conveys the recording medium 47 fed by the pickup roller 48, to a conveying path 50. Reference numeral 51 denotes a conveying roller disposed on the exit side of the conveying path 50.

Next, an example of the operation of the recording apparatus will be briefly described.

At the start of recording, a recording medium 47 of specified size is fed out of the paper cassette 46 by the pickup roller 48. The fed recording medium 47 is conveyed onto a conveying belt 44 by the conveying rollers 49 and 51.

When the leading edge of the recording medium 47 reaches a position under each of the recording heads H1000Bk to H1000Y, the heating resistance elements of the respective recording heads are driven according to the recording data.

By driving the heating resistance elements, ink droplets according to the image information are ejected from the ejection ports onto the surface of the recording medium 47, and recording is thereby performed.

As described above, by applying a specific recording signal to each of the recording heads corresponding to cyan, magenta, yellow, and black inks, a color image may be formed.

The ink jet recording heads according to aspects of the present invention can be applied not only to a full-line type recording apparatus such as that described with reference to FIG. 11, but also to a so-called serial recording apparatus having a relatively long-sized recording head.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-157984 filed Jun. 17, 2008 and No. 2009-111125 filed Apr. 30, 2009, which are hereby incorporated by reference herein in their entirety.

What is claimed is:

1. A liquid ejection head comprising:

at least one liquid ejecting substrate for ejecting liquid;

a supporting member for supporting the at least one liquid ejecting substrate, the at least one liquid ejecting substrate being fixed to the supporting member; and a plurality of liquid supplying members for supplying liquid including a same color to the at least one liquid ejecting substrate through the supporting member, the plurality of supplying members having liquid chambers for storing liquid, a linear expansivity of each of the liquid supplying members being different from a linear expansivity of the supporting member, wherein the plurality of the liquid supplying members are arranged along a longitudinal direction of the supporting member, each of the liquid supplying members being bonded to the supporting member.

2. The liquid ejection head according to claim 1, wherein the plurality of the liquid supplying members are separate from each other, the linear expansivity of each of the liquid supplying members being larger than the linear expansivity of the supporting member.

3. The liquid ejection head according to claim 1, wherein at least a portion of the plurality of the liquid supplying members are arranged along a direction perpendicular to the longitudinal direction, each of the liquid supplying members being bonded to the surface that is opposite a main surface of the supporting member.

4. The liquid ejection head according to claim 1, wherein the plurality of the liquid supplying members arranged along the longitudinal direction are arranged so as not to be in contact with each other with respect to the longitudinal direction at room temperature.

5. The liquid ejection head according to claim 1, wherein the plurality of the liquid supplying members arranged along the longitudinal direction are arranged so as not to be in contact with each other with respect to the longitudinal direction at a temperature during use of the liquid ejection head.

6. The liquid ejection head according to claim 1, wherein a plurality of liquid ejecting substrates, each of which has an ejection port group, are arranged along the longitudinal direction.

7. The liquid ejection head according to claim 6, wherein a plurality of ejection port groups form a continuous array in the longitudinal direction.

8. The liquid ejection head according to claim 6, wherein the plurality of the liquid ejecting substrates are arranged in a staggered manner.

9. The liquid ejection head according to claim 1, wherein each of a plurality of liquid ejecting substrates is provided with a corresponding one of the plurality of the liquid supplying members.

10. The liquid ejection head according to claim 1, wherein the supporting member is a single member.

11. The liquid ejection head according to claim 1, wherein the supporting member is formed of a ceramic material.

12. The liquid ejection head according to claim 1, wherein the liquid supplying members are formed of a resin material.

13. The liquid ejection head according to claim 1, wherein liquid is supplied to each liquid supplying member from a tank that contains liquid.

14. The liquid ejection head according to claim 13, wherein the tank is detachable from the liquid ejection head, and the liquid supplying members are capable of detachably holding the tank.

15. The liquid ejection head according to claim 1, wherein the liquid supplying members are capable of functioning as a tank that contains liquid.

16. A recording apparatus comprising:

the liquid ejection head according to claim 1, wherein the recording apparatus performs recording on a recording medium using the liquid ejection head.

17. A liquid ejection head comprising:

at least one liquid ejecting substrate for ejecting liquid;

a supporting member for supporting the at least one liquid ejecting substrate, the at least one liquid ejecting substrate being fixed to the supporting member; and a plurality of liquid supplying members for supplying liquid including a same color to the at least one liquid ejecting substrate through the supporting member, the plurality of the supplying members having liquid chambers for storing liquid, a linear expansivity of each of the liquid supplying members being different from a linear expansivity of the supporting member, wherein the plurality of the liquid supplying members are arranged along a longitudinal direction of the supporting member, each of the liquid supplying members being joined to the supporting member.

18. A liquid ejection head comprising:

at least one liquid ejecting substrate for ejecting liquid;

a supporting member for supporting the at least one liquid ejecting substrate, the at least one liquid ejecting substrate being fixed to the supporting member; and a plurality of liquid supplying members for supplying liquid to the at least one liquid ejecting substrate through the supporting member, the plurality of the supplying members having liquid chambers for storing liquid, a linear expansivity of each of the liquid supplying members being larger than a linear expansivity of the supporting member, wherein the plurality of the liquid supplying members are arranged along a longitudinal direction of the supporting member and separate from each other, each of the liquid supplying members being joined to the supporting member.

* * * * *